US006168540B1

(12) United States Patent
McKenna

(10) Patent No.: US 6,168,540 B1
(45) Date of Patent: Jan. 2, 2001

(54) PORTABLE APPARATUS FOR PRACTICING BATTING

(76) Inventor: Joe McKenna, ARC Sports, Rte. 121, North Salem, NY (US) 10560

( * ) Notice: Under 35 U.S.C. 154(b), the term of this patent shall be extended for 0 days.

(21) Appl. No.: 09/340,469

(22) Filed: Jun. 28, 1999

(51) Int. Cl.[7] ..... A63B 69/00
(52) U.S. Cl. ..... 473/426; 473/421; 473/430
(58) Field of Search ..... 473/421–430, 473/197, 491–495, 102, 103, 104, 116, 117–119; 273/410

(56) References Cited

U.S. PATENT DOCUMENTS

| | | | | |
|---|---|---|---|---|
| 2,839,300 | * | 6/1958 | Blaha et al. | 473/430 |
| 3,001,795 | * | 9/1961 | Johnson, Jr. | 473/197 |
| 4,127,267 | * | 11/1978 | Bay et al. | 473/197 |
| 4,523,760 | * | 6/1985 | Bednarczuk | 473/197 |
| 4,735,413 | * | 4/1988 | Yamanouchi et al. | 473/429 |
| 5,040,791 | * | 8/1991 | Ratajac et al. | 473/426 |
| 5,351,948 | | 10/1994 | Thomas | 273/26 A |
| 5,458,326 | | 10/1995 | Marcyes | 273/26 E |
| 5,588,646 | | 12/1996 | Dickson | 473/426 |
| 5,662,537 | | 9/1997 | Zuber | 473/426 |
| 5,766,102 | | 6/1998 | Lawson et al. | 473/428 |
| 5,795,250 | * | 8/1998 | Cripe | 473/426 |

* cited by examiner

*Primary Examiner*—Jeanette Chapman
*Assistant Examiner*—Mitra Aryanpour

(57) ABSTRACT

A portable apparatus for practicing batting that includes a frame, a net, and a ball. Each lower terminal end of the frame has a ball-engaging eye bolt. A pair of net-engaging uprights of the frame have a pair of tubes that are formed as one-piece therewith for ease of manufacture by eliminating a need for welding. Button fasteners replaceably maintain the members of the frame together for ease of fabrication and collapsing by eliminating a need for nuts and bolts. A second upper member of the frame has a plurality of ball-engaging blind bores. A lowermost terminal edge of the net drapes so as to prevent any balls from rolling thereunder while providing a dampening effect for the ball when hit thereagainst and is free as a result of the frame being void of a lower cross member for eliminating rebound of a ball that hits low on the net. The ball includes a swivel pulley and a pair of ball-engaging cords, each of which extends from an associated ball-engaging eye bolt to slightly below the ball where they are knotted and then extend together upwardly through a throughbore in the ball, with a snug friction fit, where one ball-engaging cord is then knotted to another ball-engaging cord slightly above the ball and then the another ball-engaging cord extends along the swivel pulley and terminates in a ball-engaging hook that selectively engages one ball-engaging blind bore for adjusting height of the ball from the ground.

29 Claims, 1 Drawing Sheet

PORTABLE APPARATUS FOR PRACTICING BATTING

BACKGROUND OF THE INVENTION

1. Field of the Invention

The present invention relates to a batting practice assembly. More particularly, the present invention relates to a portable apparatus for practicing batting.

2. Description of the Prior Art

Numerous innovations for portable batting practice assemblies have been provided in the prior art that will be described. Even though these innovations may be suitable for the specific individual purposes to which they address, however, they differ from the present invention.

A FIRST EXAMPLE, U.S. Pat. No. 5,040,791 to Ratajac et al. teaches a collapsible portable batting cage having an upper frame assembly, a lower frame assembly, and a rear frame assembly. A length of shock cord is threaded through a vertical bore hole. The top end of the shock cord passes through an eye bolt on the front end of the upper frame assembly and its free end is detachably secured to the top edge of the rear assembly. The bottom end of the shock cord is passed through an eye bolt mounted on the front end of the lower frame assembly and it has its free end detachably secured to the bottom edge of the rear assembly. There is structure on the respective top edge and bottom edge of the rear frame assembly for adjusting the height of the static position of the ball prior to a person taking practice batting swings against it. A safety line is passed through the horizontal bore hole of the bail and its respective ends are secured to the left and right upright tubular members of the rear frame assembly. The batting cage is both portable due to the nature of its light weight components and it is also collapsible which allows it to be stored or carried in a compact manner.

A SECOND EXAMPLE, U.S. Pat. No. 5,351,948 to Thomas teaches a portable ball receiving device with attachments for hitting and throwing. A lightweight frame with a large aperture for receiving a multitude of sports related balls. The main frame members are coupled at midpoint to allow for easy separation or connection. The rear base folds onto the same plane with the vertical and oblique members when in a portable configuration. It includes a receiving net to catch and contain balls which are hit, thrown, or kicked into the frame aperture. Attachments include a vertically adjustable batting tee and a strike zone that hooks to the corners for easy use.

A THIRD EXAMPLE, U.S. Pat. No. 5,458,326 to Marcyes teaches a batting practice apparatus that employs a cyclone fence as an upright, rigid support. A rigid, horizontal arm is detachably secured at one end to the top of the fence. At the other end of the horizontal arm is detachably secured the upper end of a vertically extending shock cord. At the other end of the shock cord is attached an anchoring spike. Intermediate the ends of the shock cord is a ball. The shock cord passes freely through the ball along its vertical axis. A tether passes horizontally through the ball at a location confronting the fence. Opposite ends of the tether are removably secured to the fence to form a triangle for adjusting the horizontal location of the ball. While the tether is detached from the fence at either end, the ball is movable along the shock cord to a desired height. When the tether is attached to the fence at each end in a taut state, the ball is maintained at the adjusted height along the shock cord.

A FOURTH EXAMPLE, U.S. Pat. No. 5,588,646 to Dickson teaches a batting practice device consisting of a framework with a horizontal base in the shape of a "T" with a vertical member affixed to the intersection of said horizontal "T". A second horizontal member centered and affixed to the top of said vertical member to form arms of a vertical "T" that are parallel to the arms of said horizontal "T". A ball target, baseball, softball, etc. is supported by a flexible means of suspension system. Whereas, the ball is supported at a degree of angle relative to the ground by two upper suspension members extending at outward angles to the top arm of the frame, and a lower suspension member extending outward to the lower tip of the base of the frame forming a "Y" configuration. Another, line of similar flexible means is attached to the intersection of said horizontal and vertical "T"'s, to stop return velocity of the ball after being hit by a bat. The framework is adjustable in height and length to facilitate lowering and raising the position of the ball. The framework is collapsible to allow ease of transportation.

A FIFTH EXAMPLE, U.S. Pat. No. 5,662,537 to Zuber teaches a batting practice apparatus that includes a ball, an elongated support arm made from PVC pipe and various PVC fittings, and a strand of flexible material tethering the ball from the support arm. A PVC adapter fitting is provided on the first end portion of the support arm for removably attaching the support arm to a separate mounting member. A PVC tee fitting is provided on the second end portion of the support arm for providing a rotatable structure on the support arm. A PVC plug fitting is secured to the PVC tee fitting, and the strand is secured to the PVC plug fitting. Various mounting members are disclosed to mount the apparatus on various existing supporting structures, including a post, a chain-link fence, and an umbrella stand base.

A SIXTH EXAMPLE, U.S. Pat. No. 5,766,102 to Lawson et al. teaches a training device for batters which aids a batter in practicing and developing the batting swing including an upright member having a number of arm engagement fittings. The upright member has a horizontal member attached at approximately its midpoint, for supporting the device on a support structure, typically a top rail of a fence. The upright member is secured to the fence or other support structure by a tensionable strap. A horizontal arm is removably mountable in any of the vertically oriented arm engagement mechanisms. A tether depends by its first end from the horizontal arm. A ball is slidably adjustable along the tether. The second end of the tether is attached to the support structure to limit travel of the ball and tether. Because the training device for batters has a number of locations along the length of the upright member at which the horizontal arm member is mountable, the device may be attached to and used on support structures having a variety of heights. In addition the device includes an adapter which allows the training device to be surface mounted on a variety of support structures.

A SEVENTH EXAMPLE, U.S. Pat. No. 5,795,250 to Cripe teaches a practice device for improving batting, pitching, and fielding skills. The device includes a backstop which can be adjusted at different angles to the vertical to return balls striking the backstop on the ground or in the air. With the device configured for batting practice, a ball is positioned at a selected height above and at a selected location across the span of a home plate by a suspension system which includes a cantilevered arm fixed to the backstop, a tether, and a motion damping arrangement which almost instantaneously brings the tethered ball to rest after the ball is struck and rebounds to its rest position. The components of the practice device can be and quickly folded or otherwise positioned against the backstop to provide a compact, easily stored package. The practice device can also be easily configured as a wheeled cart easily moved from one location to another along with ball bags and other equipment stowable on the cart.

It is apparent that numerous innovations for portable batting practice assemblies have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a portable apparatus for practicing batting that avoids the disadvantages of the prior art.

ANOTHER OBJECT of the present invention is to provide a portable apparatus for practicing batting that is simple and inexpensive to manufacture.

STILL ANOTHER OBJECT of the present invention is to provide a portable apparatus for practicing batting that is simple to use.

BRIEFLY STATED, YET ANOTHER OBJECT of the present invention is to provide a portable apparatus for practicing batting that includes a frame, a net, and a ball. Each lower terminal end of the frame has a ball-engaging eye bolt. A pair of net-engaging uprights of the frame have a pair of tubes that are formed as one-piece therewith for ease of manufacture by eliminating a need for welding. Button fasteners replaceably maintain the members of the frame together for ease of fabrication and collapsing by eliminating a need for nuts and bolts. A second upper member of the frame has a plurality of ball-engaging blind bores. A lowermost terminal edge of the net drapes so as to prevent any balls from rolling thereunder while providing a dampening effect for the ball when hit thereagainst and is free as a result of the frame being void of a lower cross member for eliminating rebound of a ball that hits low on the net. The ball includes a swivel pulley and a pair of ball-engaging cords, each of which extends from an associated ball-engaging eye bolt to slightly below the ball where they are knotted and then extend together upwardly through a throughbore in the ball, with a snug friction fit, where one ball-engaging cord is then knotted to another ball-engaging cord slightly above the ball and then the another ball-engaging cord extends along the swivel pulley and terminates in a ball-engaging hook that selectively engages one ball-engaging blind bore for adjusting height of the ball from the ground.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figures 1, 2, 3, 4, 5, 6:
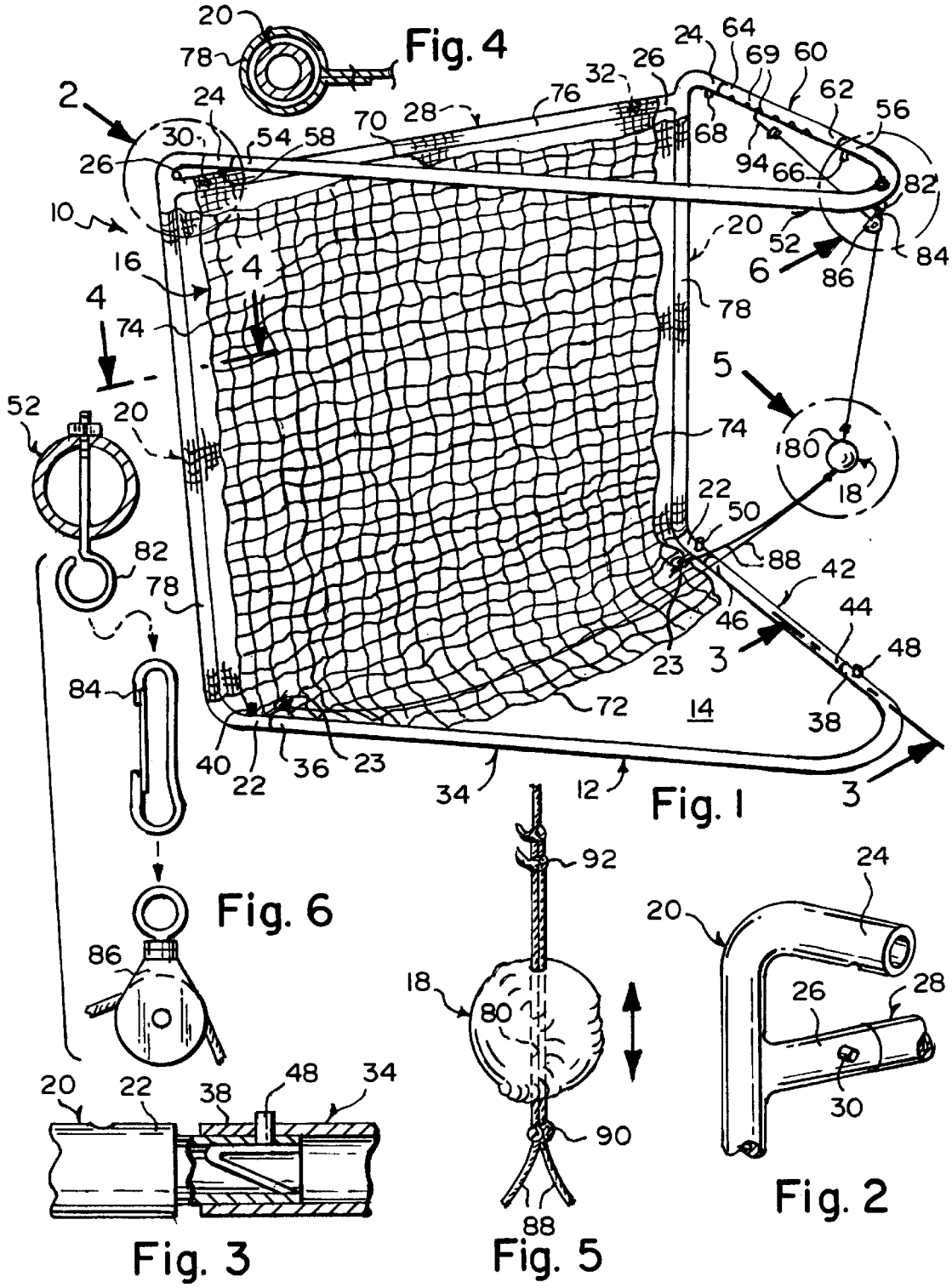
FIG. 1 is a diagrammatic perspective view of the present invention assembled.
FIG. 2 is an enlarged diagrammatic perspective view of the area generally enclosed by the dotted curve identified by arrow 2 in FIG. 1.
FIG. 3 is an enlarged diagrammatic cross sectional view taken on line 3—3 in FIG. 1.
FIG. 4 is an enlarged diagrammatic cross sectional view taken on line 4—4 in FIG. 1.
FIG. 5 is an enlarged diagrammatic perspective view of the area generally enclosed by the dotted curve identified by arrow 5 in FIG. 1.
FIG. 6 is an enlarged exploded diagrammatic elevational view, in partial section, of the area generally enclosed by the dotted curve identified by arrow 6 in FIG. 1.

10 portable apparatus for practicing batting of the present invention
12 frame for resting on ground 14
14 ground
16 net
18 ball
20 pair of net-engaging uprights of frame 12
22 lowermost ground-engaging terminal ends of pair of net-engaging uprights 20 of frame 12
23 ball-engaging eye bolt of each lowermost ground-engaging terminal end of lowermost ground-engaging terminal ends 22 of pair of net-engaging uprights 20 of frame 12
24 uppermost terminal ends of pair of net-engaging uprights 20 of frame 12
26 pair of tubes of pair of net-engaging uprights 20 of frame 12
28 upper net-engaging cross member of frame 12
30 first button fastener of frame 12
32 second button fastener of frame 12
34 first lower ground-engaging member of frame 12 for resting on ground 14
36 proximal end of first lower ground-engaging member 34 of frame 12
38 distal end of first lower ground-engaging member 34 of frame 12
40 third button fastener of frame 12
42 second lower ground-engaging member of frame 12 for resting on ground 14
44 proximal end of second lower ground-engaging member 42 of frame 12
46 distal end of second lower ground-engaging member 42 of frame 12
48 fourth button fastener of frame 12
50 fifth button fastener of frame 12
52 first upper member of frame 12
54 proximal end of first upper member 52 of frame 12
56 distal end 56 of first upper member 52 of frame 12
58 sixth button fastener of frame 12
60 second upper member of frame 12
62 proximal end of second upper member 60 of frame 12
64 distal end of second upper member 60 of frame 12
66 seventh button fastener of frame 12
68 eighth button fastener of frame 12
69 plurality of ball-engaging blind bores in second upper member 60 of frame 12
70 uppermost terminal edge of net 16
72 lowermost terminal edge of net 16
74 pair of sidewardmost terminal edges of net 16
76 upper cross member-engaging sleeve formed by uppermost terminal edge 70 of net 16
78 upright-engaging sleeves formed by pair of sidewardmost terminal edges 74 of net 16

80 throughbore in ball 18
82 pulley-engaging eye bolt of ball 18
84 pulley-engaging quick disconnect link clip of ball 18
86 swivel pulley of ball 18
88 pair of ball-engaging cords of ball 18
90 lower knot of pair of ball-engaging cords 88 of ball 18
92 upper knot of pair of ball-engaging cords 88 of ball 18
94 ball-engaging hook of pair of ball-engaging cords 88 of ball 18

DETAILED DESCRIPTION OF THE PREFERRED EMBODIMENT

Referring now to the figures, in which like numerals indicate like parts, and particularly to FIG. 1, the portable apparatus for practicing batting of the present invention is shown generally at 10.

The general configuration of the portable apparatus for practicing batting 10 can best be seen in FIG. 1, and as such, will be discussed with reference thereto.

The portable apparatus for practicing batting 10 comprises a frame 12 for resting on the ground 14, a net 16 extending across the frame 12, and a ball 18 operatively connected to the frame 12.

The configuration of the frame 12 can best be seen in FIGS. 1–3, and as such, will be discussed with reference thereto.

The frame 12 is tubular and comprises a pair of net-engaging uprights 20 that are straight, parallel, spaced apart, and lie in a first plane.

The pair of net-engaging uprights 20 of the frame 12 have lowermost ground-engaging terminal ends 22 that bend slightly forwardly and inwardly to form right angle shaped bottom corners and uppermost terminal ends 24 that bend slightly forwardly and inwardly to form right angle shaped top corners and which are parallel to the lowermost ground-engaging terminal ends 22 of the pair of net-engaging uprights 20 of the frame 12, respectively.

Each lowermost ground-engaging terminal end 22 of the pair of net-engaging uprights 20 of the frame 12 has a ball-engaging eye bolt 23 that extends inwardly therefrom towards the other lowermost ground-engaging terminal end 22 of the pair of net-engaging uprights 20.

The pair of net-engaging uprights 20 of the frame 12 further have a pair of tubes 26 that are formed as one-piece with and extend slightly inwardly therefrom, respectively, so as to afford ease of manufacture by eliminating a need for welding and to afford ease of fabrication and collapsing by eliminating a need for nuts and bolts.

The pair of tubes 26 of the pair of net-engaging uprights 20 of the frame 12 extend in the first plane of the pair of net-engaging uprights 20 of the frame 12 and are disposed slightly below the uppermost terminal ends 24 of the pair of net-engaging uprights 20 of the frame 12, respectively.

The frame 12 further comprises an upper net-engaging cross member 28 that is horizontally-oriented and extends telescopically, slidingly, and replaceably out from one tube 26 of the pair of net-engaging uprights 20 of the frame 12 and telescopically, slidingly, and replaceably into another tube 26 of the pair of net-engaging uprights 20 of the frame 12.

The upper net-engaging cross member 28 of the frame 12 is replaceably maintained in the one tube 26 of the pair of net-engaging uprights 20 of the frame 12 by a first button fastener 30 and is replaceably maintained in the another tube 26 of the pair of net-engaging uprights 20 of the frame 12 by a second button fastener 32 so as to afford ease of fabrication and collapsing by eliminating a need for nuts and bolts.

The frame 12 further comprises a first lower ground-engaging member 34 that is horizontally-oriented for resting on the ground 14, J-shaped, and extends from a proximal end 36 thereof replaceably, straight, telescopically, slidingly, forwardly, and inwardly from out of the lowermost ground-engaging terminal end 22 of one net-engaging upright 20 of the frame 12 to a distal end 38 that hooks rearwardly and inwardly to form a substantially V-shaped bottom front end.

The first lower ground-engaging member 34 of the frame 12 is replaceably maintained in the lowermost ground-engaging terminal end 22 of the one net-engaging upright 20 of the frame 12 by a third button fastener 40 so as to afford ease of fabrication and collapsing by eliminating a need for nuts and bolts.

The frame 12 further comprises a second lower ground-engaging member 42 that is horizontally-oriented for resting on the ground 14, straight, and extends replaceably, telescopically, and slidingly from a proximal end 44 thereof rearwardly outwardly from out of the distal end 38 of the first lower ground-engaging member 34 of the frame 12 to a distal end 46 that is replaceably, telescopically, and slidingly received by the lowermost ground-engaging terminal end 22 of another net-engaging upright 20 of the frame 12.

The second lower ground-engaging member 42 of the frame 12 is replaceably maintained in the distal end 38 of the first lower ground-engaging member 34 of the frame 12 by a fourth button fastener 48 and is replaceably maintained in the lowermost ground-engaging terminal end 22 of the another net-engaging upright 20 of the frame 12 by a fifth button fastener 50 so as to afford ease of fabrication and collapsing by eliminating a need for nuts and bolts.

The first lower ground-engaging member 34 of the frame 12 and the second lower ground-engaging member 42 of the frame 12 lie in a second plane that is generally perpendicular to the first plane.

The frame 12 further comprises a first upper member 52 that is horizontally-oriented, J-shaped, and extends from a proximal end 54 thereof replaceably, telescopically, slidingly, straight, forwardly, and inwardly out of the uppermost terminal end 24 of the one net-engaging upright 20 of the frame 12 to a distal end 56 that hooks rearwardly and inwardly to form a substantially V-shaped top front end.

The first upper member 52 of the frame 12 is parallel to and spaced vertically above the first lower ground-engaging member 34 of the frame 12, a predetermined height.

The first upper member 52 of the frame 12 is replaceably maintained in the uppermost terminal end 24 of the one net-engaging upright 20 of the frame 12 by a sixth button fastener 58 so as to afford ease of fabrication and collapsing by eliminating a need for nuts and bolts.

The frame 12 further comprises a second upper member 60 that is horizontally-oriented, straight, and extends replaceably, telescopically, and slidingly from a proximal end 62 thereof rearwardly outwardly out of the distal end 56 of the first upper member 52 of the frame 12 to a distal end 64 that is replaceably, telescopically, and slidingly received by the uppermost terminal end 24 of the another net-engaging upright 20 of the frame 12.

The second upper member 60 of the frame 12 is parallel to and spaced vertically above the second lower ground-engaging member 42 of the frame 12, a predetermined height.

The second upper member 60 of the frame 12 is replaceable maintained in the distal end 56 of the first upper member 52 of the frame 12 by a seventh button fastener 66 and is replaceable maintained in the uppermost terminal end 24 of the another net-engaging upright 20 of the frame 12 by an eighth button fastener 68 so as to afford ease of fabrication and collapsing by eliminating a need for nuts and bolts.

The second upper member 60 of the frame has a plurality of ball-engaging blind bores 69 that are spaced longitudinally therealong and which face the first upper member 52 of the frame 12.

The first upper member 52 of the frame 12 and the second upper member 60 of the frame 12 lie in a third plane that is generally perpendicular to the first plane and generally parallel to the second plane.

The frame 12 is void of a lower cross member that would have connected the lowermost ground-engaging terminal ends 22 of the pair of net-engaging uprights 20 of the frame 12 to each other.

Even though the frame 12 being void of a lower cross member may be considered a negative limitation by some, it is the only way, and by far the clearest way, to state the limitation, and therefore must be considered in determining patentability. Support for this assertion can be found in the notice entitled "*Practice Re: Technical Rejections*," dated Apr. 30, 1965 (814 O.G. 715), which states that:

"The inclusion of a negative limitation shall not, in itself, be considered a sufficient basis for objection to or rejection of a claim." [Emphasis added]

And, in *In re Duva,* 156 USPQ 90, 94 (CCPA 1967), where the Court stated:

". . . it [is] held proper to claim a negative limitation even if a positive expression could have been employed and even at the 'point of novelty' . . . " [Empasis added]

The fact that the frame 12 is void of any lower cross member is of critical importance and obviously a point of novelty, as will be discussed further infra.

The configuration of the net 16 can best be seen in FIGS. 1 and 4, and as such, will be discussed with reference thereto.

The net 16 has an uppermost terminal edge 70, a lowermost terminal edge 72, and a pair of sidewardmost terminal edges 74.

The uppermost terminal edge 70 of the net 16 is formed into an upper cross member-engaging sleeve 76 which slidingly and snugly receives the upper cross member 28 of the frame 12.

The pair of sidewardmost terminal edges 74 of the net 16 are formed into upright-engaging sleeves 78 which slidingly and snugly receive the pair of net-engaging uprights 20 of the frame 12, respectively.

The lowermost terminal edge 72 of the net 16 drapes into the second plane of the frame 12 so as to prevent any balls from rolling thereunder and is free as a result of the frame 12 being void of a lower cross member as discussed supra.

The frame 12 being void of a lower cross member eliminates rebound of a ball that hits low on the net 16 while the draping of the net provides a dampening effect for the ball 18 when hit thereagainst.

The configuration of the ball 18 can best be seen in FIGS. 1, 5, and 6, and as such, will be discussed with reference thereto.

The ball 18 is spherically-shaped for hitting by a bat against the net 16 and has a throughbore 80 that extends vertically therethrough, along a diameter thereof.

The ball 18 further comprises a pulley-engaging eye bolt 82 that depends from the distal end 56 of the first upper member 52 of the frame 12.

The ball 18 further comprises a pulley-engaging quick disconnect link clip 84 that depends from the pulley-engaging eye bolt 82 of the ball 18.

The ball 18 further comprises a swivel pulley 86 that depends from the pulley-engaging quick disconnect link clip 84 of the ball 18.

The ball 18 further comprises a pair of ball-engaging cords 88. Each ball-engaging cord 88 extends forwardly, inwardly, and upwardly from an associated ball-engaging eye bolt 23 of the frame 12 so as to avoid being hit by a swinging bat and meet together slightly below the ball 18 where they are knotted in a lower knot 90 and then extend together upwardly through the throughbore 80 in the ball 18, with a snug friction fit, where one ball-engaging cord 88 is then knotted in an upper knot 92 to another ball-engaging cord 88 slightly above the ball 18 and then the another ball-engaging cord 88 extends along the swivel pulley 86 and terminates in a ball-engaging hook 94 that selectively engages one ball-engaging blind bores 69 in the second member 61) of the frame 12 for adjusting the height of the ball 18 from the ground 14.

The lower knot 90 and the upper knot 92 define a length therebetween through which the ball 18 moves for fine adjustment of the ball 18 position, with the snug friction fit holding the ball 18 in the adjusted position.

It will be understood that each of the elements described above, or two or more together, may also find a useful application in other types of constructions differing from the types described above.

While the invention has been illustrated and described as embodied in a portable apparatus for practicing batting, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A portable apparatus for practicing batting, comprising:

a) a frame for resting on the ground; said frame being tubular and comprising a pair of net-engaging uprights being straight, parallel, space apart, and lying in a first plane; said pair of net engaging uprights of said frame having:

I) lowermost ground-engaging terminal ends bending slightly forwardly and inwardly to form right angle shaped bottom corners;

ii) uppermost terminal ends bending slightly forwardly and inwardly to form right angle shaped top corners and which are parallel to said lowermost ground-engaging terminal ends of said pair of net-engaging uprights of said frame, respectively; said frame being void of a lower cross member that would have connected said lowermost ground-engaging terminal ends of said pair of net-engaging uprights of said frame to each other;

b) a net extending across said frame; the lowermost terminal end of the net draping into a second plane of said frame, wherein the draping of the net provides a dampening effect for a ball when hit thereagainst;

c) a ball operatively connected to said frame by connecting means, said connecting means comprising: a pair of ball-engaging cords extending forwardly, inwardly and upwardly from an associated ball-engaging eye bolt attached to the lower most ground-engaging terminal end of said pair of net-engaging uprights of said frame, so as to avoid being hit by a swinging bat and meet together slightly below the ball where they are knotted in a lower knot and then extend together upwardly through a through-bore in the ball, with a snug friction fit, where one ball-engaging cord is then knotted in an upper knot to another ball-engaging cord slightly above the ball extending upwardly to said frame; wherein said lower knot and said upper knot define a length therebetween through which the ball moves for fine adjustment of the ball position.

2. The apparatus as defined in claim 1, wherein each lowermost ground-engaging terminal end of said pair of net-engaging uprights of said frame has a ball-engaging eye bolt that extends inwardly therefrom towards the other lowermost ground-engaging terminal end of said pair of net-engaging uprights of said frame.

3. The apparatus as defined in claim 2, wherein said pair of net-engaging uprights of said frame further have a pair of tubes that are formed as one-piece with and extend slightly inwardly therefrom, respectively, so as to afford ease of manufacture by eliminating a need for welding and to afford ease of fabrication and collapsing by eliminating a need for nuts and bolts.

4. The apparatus as defined in claim 3, wherein said pair of tubes of said pair of net-engaging uprights of said frame extend in said first plane and are disposed slightly below said uppermost terminal ends of said pair of net-engaging uprights of said frame, respectively.

5. The apparatus as defined in claim 3, wherein said frame further comprises an upper net-engaging cross member that is horizontally-oriented and extends telescopically, slidingly, and replaceably out from one tube of said pair of net-engaging uprights of said frame and telescopically, slidingly, and replaceably into another tube of said pair of net-engaging uprights of said frame.

6. The apparatus as defined in claim 5, wherein said upper net-engaging cross member of said frame is replaceably maintained in said one tube of said pair of net-engaging uprights of said frame by a first button fastener and is replaceably maintained in said another tube of said pair of net-engaging uprights of said frame by a second button fastener so as to afford ease of fabrication and collapsing by eliminating a need for nuts and bolts.

7. The apparatus as defined in claim 5, wherein said frame further comprises a first lower ground-engaging member that is horizontally-oriented for resting on the ground, J-shaped, and extends from a proximal end thereof replaceably, straight, telescopically, slidingly, forwardly, and inwardly from out of said lowermost ground-engaging terminal end of one net-engaging upright of said frame to a distal end that hooks rearwardly and inwardly to form a substantially V-shaped bottom front end.

8. The apparatus as defined in claim 7, wherein said first lower ground-engaging member of said frame is replaceably maintained in said lowermost ground-engaging terminal end of said one net-engaging upright of said frame by a third button fastener so as to afford ease of fabrication and collapsing by eliminating a need for nuts and bolts.

9. The apparatus as defined in claim 7, wherein said frame further comprises a second lower ground-engaging member that is horizontally-oriented for resting on the ground, straight, and extends replaceably, telescopically, and slidingly from a proximal end thereof rearwardly outwardly from out of said distal end of said first lower ground-engaging member of said frame to a distal end that is replaceably, telescopically, and slidingly received by said lowermost ground-engaging terminal end of another net-engaging upright of said frame.

10. The apparatus as defined in claim 9, wherein said second lower ground-engaging member of said frame is replaceably maintained in said distal end of said first lower ground-engaging member of said frame by a fourth button fastener and is replaceably maintained in said lowermost ground-engaging terminal end of said another net-engaging upright of said frame by a fifth button fastener so as to afford ease of fabrication and collapsing by eliminating a need for nuts and bolts.

11. The apparatus as defined in claim 9, wherein said first lower ground-engaging member of said frame and said second lower ground-engaging member of said frame lie in a second plane that is generally perpendicular to said first plane.

12. The apparatus as defined in claim 11, wherein said frame further comprises a first upper member that is horizontally-oriented, J-shaped, and extends from a proximal end thereof replaceably, telescopically, slidingly, straight, forwardly, and inwardly out of said uppermost terminal end of said one net-engaging upright of said frame to a distal end that hooks rearwardly and inwardly to form a substantially V-shaped top front end.

13. The apparatus as defined in claim 12, wherein said first upper member of said frame is parallel to and spaced vertically above said first lower ground-engaging member of said frame, a predetermined height.

14. The apparatus as defined in claim 12, wherein said first upper member of said frame is replaceably maintained in said uppermost terminal end of said one net-engaging upright of said frame by a sixth button fastener so as to afford ease of fabrication and collapsing by eliminating a need for nuts and bolts.

15. The apparatus as defined in claim 12, wherein said frame further comprises a second upper member that is horizontally-oriented, straight, and extends replaceably, telescopically, and slidingly from a proximal end thereof rearwardly outwardly out of said distal end of said first upper member of said frame to a distal end that is replaceably, telescopically, and slidingly received by said uppermost terminal end of said another net-engaging upright of said frame.

16. The apparatus as defined in claim 13, wherein said second upper member of said frame is parallel to and spaced vertically above said second lower ground-engaging member of said frame, a predetermined height.

17. The apparatus as defined in claim 15, wherein said second upper member of said frame is replaceably maintained in said distal end of said first upper member of said frame by a seventh button fastener and is replaceably maintained in said uppermost terminal end of said another net-engaging upright of said frame by an eighth button fastener so as to afford ease of fabrication and collapsing by eliminating a need for nuts and bolts.

18. The apparatus as defined in claim 15, wherein said second upper member of said frame has a plurality of ball-engaging blind bores that are spaced longitudinally therealong and which face said first upper member of said frame.

19. The apparatus as defined in claim 15, wherein said first upper member of said frame and said second upper member of said frame lie in a third plane that is generally perpendicular to said first plane and generally parallel to said second plane.

20. The apparatus as defined in claim 11, wherein said net has:

a) an uppermost terminal edge;

b) a lowermost terminal edge; and c) a pair of sidewardmost terminal edges.

21. The apparatus as defined in claim 20, wherein said uppermost terminal edge of said net is formed into an upper cross member-engaging sleeve which slidingly and snugly receives said upper cross member of said frame.

22. The apparatus as defined in claim 21, wherein said pair of sidewardmost terminal edges of said net are formed into upright-engaging sleeves which slidingly and snugly receive said pair of net-engaging uprights of said frame, respectively.

23. The apparatus as defined in claim 20, wherein said lowermost terminal edge of said net drapes into said second plane of said frame so as to prevent any balls from rolling thereunder while providing a dampening effect for said ball when hit thereagainst and is free as a result of said frame being void of a lower cross member so as to eliminate rebound of a ball that hits low on said net.

24. The apparatus as defined in claim 18, wherein said ball is spherically-shaped for hitting by a bat against said net and has a throughbore that extends vertically therethrough, along a diameter thereof.

25. The apparatus as defined in claim 24, wherein said ball further comprises a pulley-engaging eye bolt that depends from said distal end of said first upper member of said frame.

26. The apparatus as defined in claim 25, wherein said ball further comprises a pulley-engaging quick disconnect link clip that depends from said pulley-engaging eye bolt of said ball.

27. The apparatus as defined in claim 26, wherein said ball further comprises a swivel pulley that depends from said pulley-engaging quick disconnect link clip of said ball.

28. The apparatus as defined in claim 27, wherein said ball further comprises a p air of ball-engaging cords; each ball-engaging cord extends forwardly, inwardly, and upwardly from an associated ball-engaging eye bolt of said frame so as to avoid being hit by a swinging bat and meet together slightly below said ball where they are knotted in a lower knot and then extend together upwardly through said throughbore in said ball, with a snug friction fit, where one ball-engaging cord is then knotted in an upper knot to another ball-engaging cord slightly above said ball and then said another ball-engaging cord extends along said swivel pulley and terminates in a ball-engaging hook that selectively engages one ball-engaging blind bore in said second member of said frame for adjusting height of said ball from the ground.

29. The apparatus as defined in claim 28, wherein said lower knot and said upper knot define a length therebetween through which said ball moves for fine adjustment of said ball position, with said snug friction fit holding said ball in said adjusted position.

* * * * *